US006851982B2

(12) United States Patent
Ku

(10) Patent No.: US 6,851,982 B2
(45) Date of Patent: Feb. 8, 2005

(54) HOLDER FUSE DEVICE

(76) Inventor: Jung Sheng Ku, P.O. Box 10-69, Chong Ho, Taipei (TW), 235

( * ) Notice: Subject to any disclaimer, the term of this patent is extended or adjusted under 35 U.S.C. 154(b) by 0 days.

(21) Appl. No.: 10/733,708

(22) Filed: Dec. 9, 2003

(65) Prior Publication Data

US 2004/0127100 A1 Jul. 1, 2004

Related U.S. Application Data

(63) Continuation of application No. 09/863,916, filed on May 21, 2001, now abandoned.

(51) Int. Cl.[7] ..... H01R 13/68
(52) U.S. Cl. ..... 439/621; 439/833
(58) Field of Search ..... 439/620, 621, 439/622, 833, 830

(56) References Cited

U.S. PATENT DOCUMENTS 4,938,715 A * 7/1990 Jones et al. ..... 439/621
5,227,759 A * 7/1993 Hatagishi ..... 337/260
5,338,228 A * 8/1994 Wright et al. ..... 439/621
5,816,858 A 10/1998 Kazarian et al. ..... 439/621
5,820,413 A 10/1998 Yamada et al. ..... 439/621
5,888,098 A 3/1999 Cheng et al. ..... 439/621
6,132,257 A 10/2000 Wang et al. ..... 439/622
6,162,098 A 12/2000 Cheng et al. ..... 439/621
6,280,253 B1 * 8/2001 Kraus et al. ..... 439/621

* cited by examiner

*Primary Examiner*—Hien Vu

(57) ABSTRACT

A holder fuse device includes a base, two planar conductor blades secured to the base and extended outward of the base, each of the planar conductor blades includes a groove formed between two ears, and an opening communicating with the groove and having a width greater than that of the groove of the planar conductor blades. A fuse member includes two ends engaged into the openings via the grooves of the planar conductor blades, and having a diameter greater than that of the opening of the planar conductor blades, to secure and retain the ends of the fuse member in the opening of the planar conductor blades.

1 Claim, 6 Drawing Sheets

HOLDER FUSE DEVICE

The present invention is a continuation application of U.S. patent application Ser. No. 09/863,916, filed on 21 May 2001, now abandoned.

BACKGROUND OF THE INVENTION

1. Field of the Invention

The present invention relates to a holder fuse device, and more particularly to a holder fuse device having a simplified structure for facilitating the manufacturing of the holder fuse device.

2. Description of the Prior Art

Various kinds of typical holder fuse devices have been developed and widely used today, and comprise a fuse member having two ends to be engaged into or retained by sockets.

For example, U.S. Pat. No. 5,816,858 to Kazarian et al. discloses one of the typical holder fuse devices and comprises a fuse member having two planar connectors to be engaged into or retained by sockets. A complicated fuse box is required to be provided and includes one or more complicated sockets to receive and retain the planar connectors of the fuse member.

U.S. Pat. No. 5,820,413 to Yamada et al. discloses another typical holder fuse device and comprises a fuse member having two ends to be engaged into or retained by curved or U-shaped connected terminals, which are required to be formed and bent from planar members, to form socket openings and to receive and retain the ends of the fuse member.

U.S. Pat. No. 5,888,098 to Cheng et al. discloses a further typical holder fuse device and comprises a fuse member having two ends to be engaged into or retained by receptacles, which include a number of spring blades to retain the fuse member, and which include a complicated configuration that may not be easily manufactured.

U.S. Pat. No. 6,132,257 to Wang et al. discloses a still further typical holder fuse device and comprises a fuse member to be secured to a cover plate with holding sleeves, and having two ends to be engaged into or retained by curved or U-shaped connected terminals, which are required to be formed and bent from planar members, to form socket openings and to receive and retain the ends of the fuse member.

U.S. Pat. No. 6,162,098 to Cheng et al. discloses a still further typical holder fuse device and comprises a fuse member having two ends to be engaged into or retained by receptacles, which include a complicated configuration that may not be easily manufactured.

The present invention has arisen to mitigate and/or obviate the afore-described disadvantages of the conventional holder fuse devices.

SUMMARY OF THE INVENTION

The primary objective of the present invention is to provide a holder fuse device including a simplified structure for facilitating the manufacturing of the holder fuse device.

In accordance with one aspect of the invention, there is provided a holder fuse device comprising a base, two planar conductor blades secured to the base and extended outward of the base, each of the planar conductor blades including a groove defined between two ears, and including an opening communicating with the groove thereof, the groove of each of the planar conductor blades including a width smaller than that of the opening of the planar conductor blades, and a fuse member including two ends engaged into the opening of the planar conductor blades via the grooves of the planar conductor blades, the ends of the fuse member including a diameter greater than that of the opening of the planar conductor blades, to secure and retain the ends of the fuse member in the opening of the planar conductor blades. The planar conductor blades include a greatly simplified planar configuration for allowing the planar conductor blades to be easily and quickly manufactured, and for allowing the ends of the fuse member to be easily engaged in the openings of the planar conductor blades.

Each of the planar conductor blades includes a conductor extension extended out of the base. A cover may further be provided and secured to the base, to shield the fuse member and the planar conductor blades, and to prevent the fuse member from being disengaged from the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
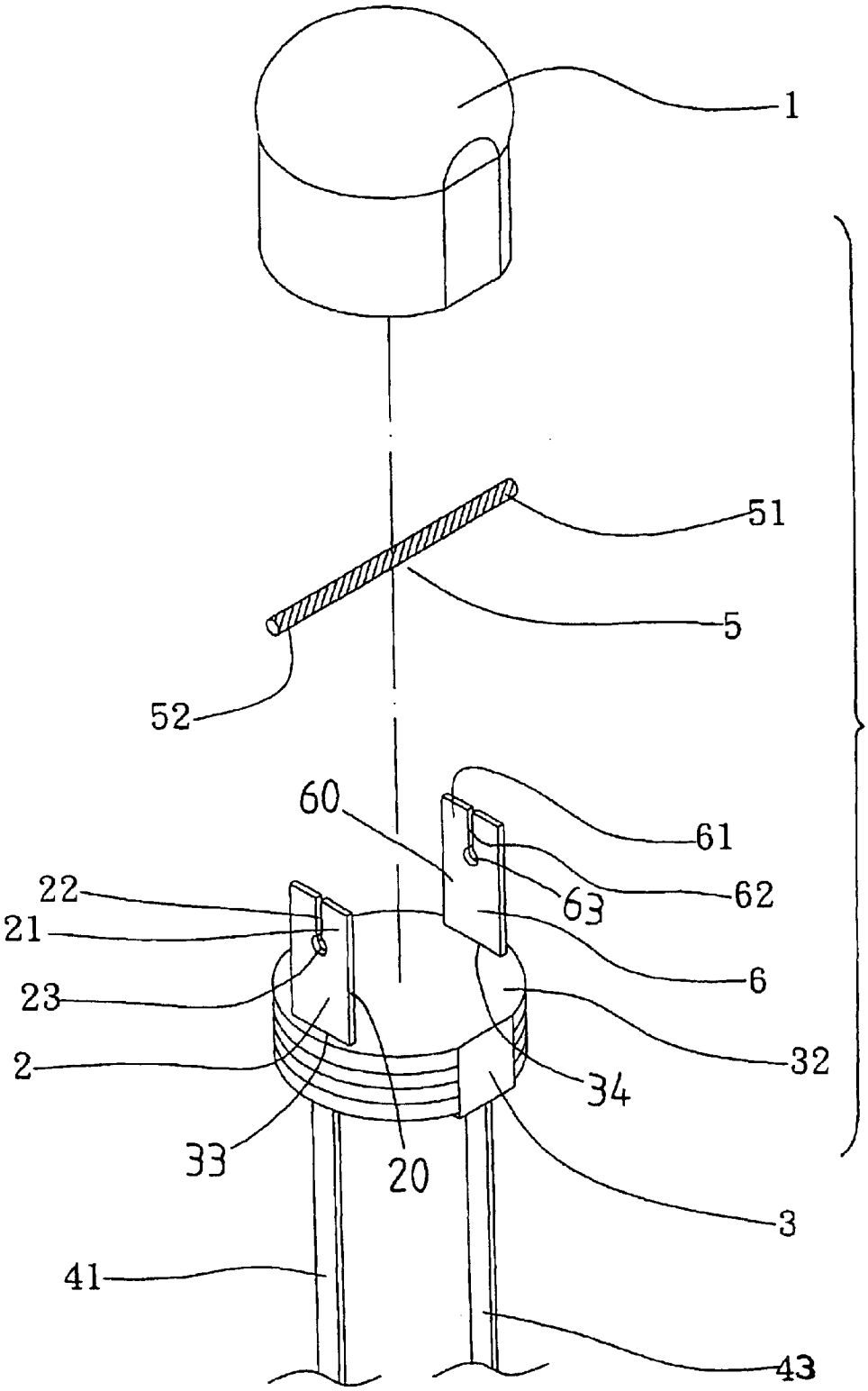
FIG. 1 is an exploded view of a holder fuse device in accordance with the present invention.
Figure 2:
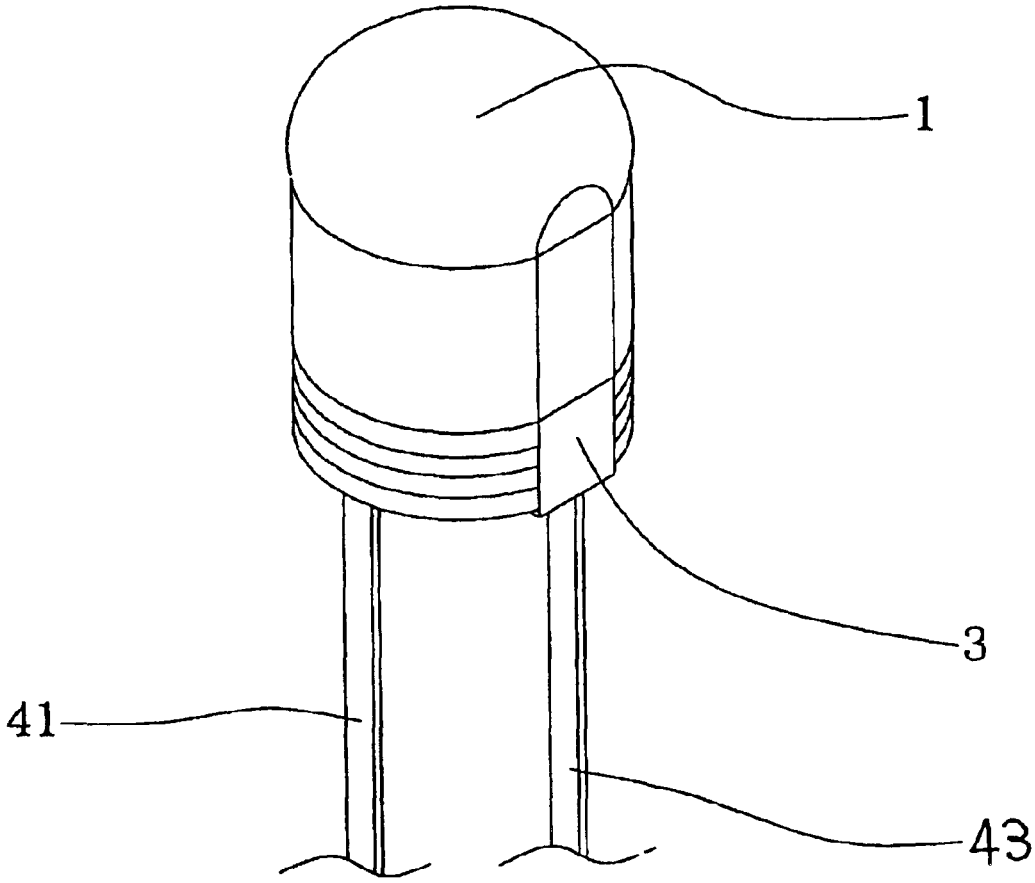
FIG. 2 is a perspective view of the holder fuse device.
Figure 3:
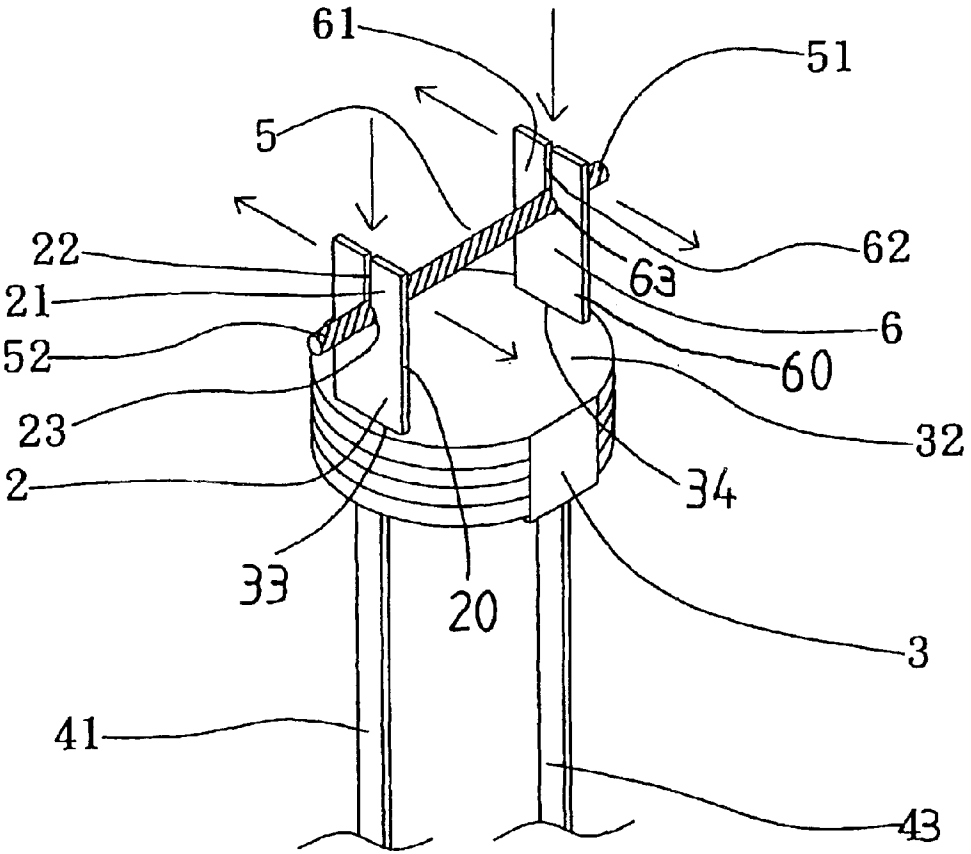
FIG. 3 is a partial perspective view similar to FIG. 2, having a cover removed, to shown an inner structure of the holder fuse device.
Figure 4:
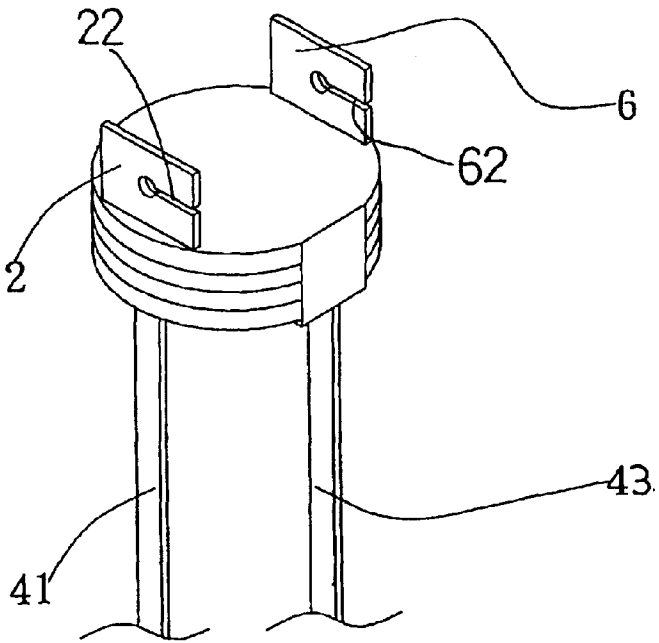
FIGS. 4, 5, 6, 7 are partial perspective views similar to FIG. 3, illustrating the other arrangements of the holder fuse device.
Figure 5:
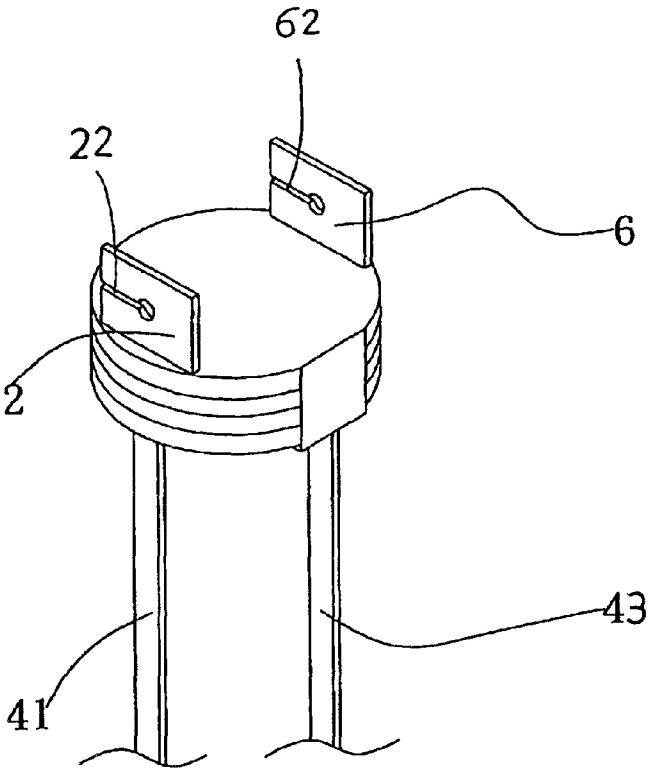
Figure 7:
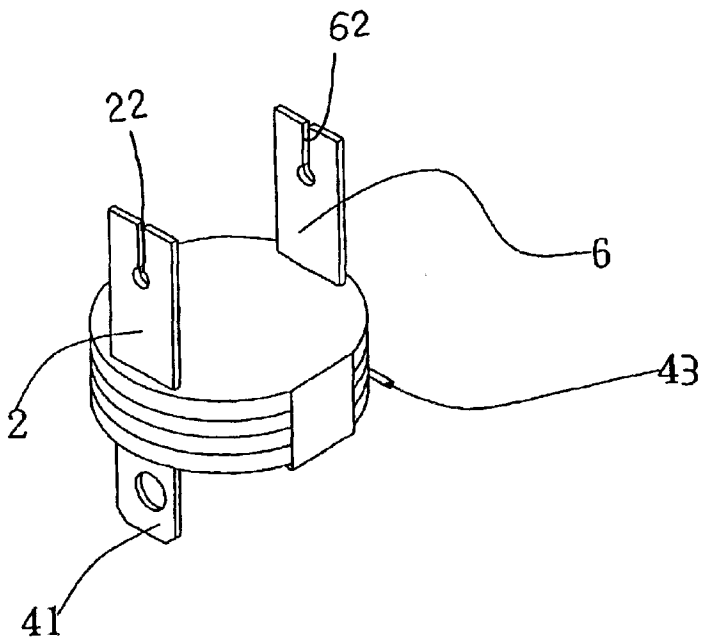
Figure 6:
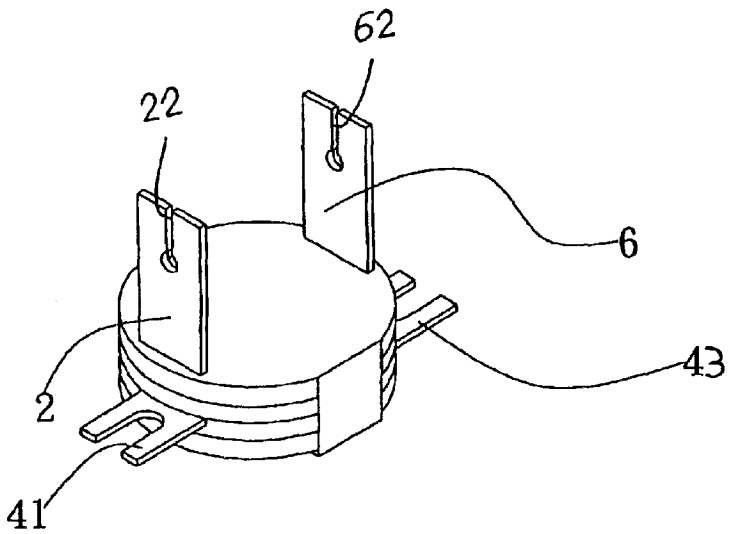

Referring to the drawings, and initially to FIGS. 1–3, a holder fuse device in accordance with the present invention comprises a base 3 including an upper portion 32, and including two slots 33, 34 formed therein and preferably formed through the base 3.

Two planar conductor blades 2, 6 are engaged into the slots 33, 34 of the base 3 respectively, and each includes one end 20, 60 extended upward or outward of the upper portion 32 of the base 3, and each includes a conductor extension 41, 43 extended downward beyond or out of the bottom of the base 3.

Each of the conductor extensions 41, 43 preferably includes a non-circular cross section, such as a polygonal cross section for facilitating the securing or the plugging or the engaging of the conductor extensions 41, 43 with the other sockets or engaging members or the like.

Each of the one ends 20, 60 of the planar conductor blades 2, 6 includes a free end portion having a groove 22, 62 formed therein, and defined between resilient ears 21, 61, and an opening 23, 63 formed in root portions of the grooves 22, 62 respectively, and having a width or a diameter greater than a width of the groove 22, 62 of the planar conductor blades 2, 6 respectively.

A fuse member 5 includes two ends 51, 52 engaged into the openings 23, 63 via such as the grooves 22, 62 of the one ends 20, 60 of the planar conductor blades 2, 6. It is preferable that the ends 51, 52 of the fuse member 5 include a width or a diameter greater than that of the grooves 22, 62 and the openings 23, 63 of the planar conductor blades 2, 6, to allow the ends 51, 52 of the fuse member 5 to be clamped and secured to the planar conductor blades 2, 6.

For example, the resilient ears 21, 61 of the planar conductor blades 2, 6 may be slightly forced or moved away from each other when the ends 51, 52 of the fuse member 5 are engaged into the grooves 22, 62 of the planar conductor blades 2, 6, and may clamp and secure the ends 51, 52 of the fuse member 5 in the ends 20, 60 of the planar conductor blades 2, 6 when the ends 51, 52 of the fuse member 5 are engaged in the openings 23, 63 of the planar conductor blades 2, 6.

A cover 1 may further be provided and may be secured onto the base 3 with such as threading engagements, adhesive materials, or by welding processes, or the like, to shield or retain the fuse member 5 within the base 3, or to prevent the fuse member 5 from being disengaged from the base 3.

Referring next to FIGS. 4–8, the grooves 22, 62 of the planar conductor blades 2, 6 may be directed toward different directions. The conductor extensions 41, 43 may be formed into different shapes or contours, for easily plugging into various sockets, or for securing to various objects with welding processes or the like.

Figure 8:
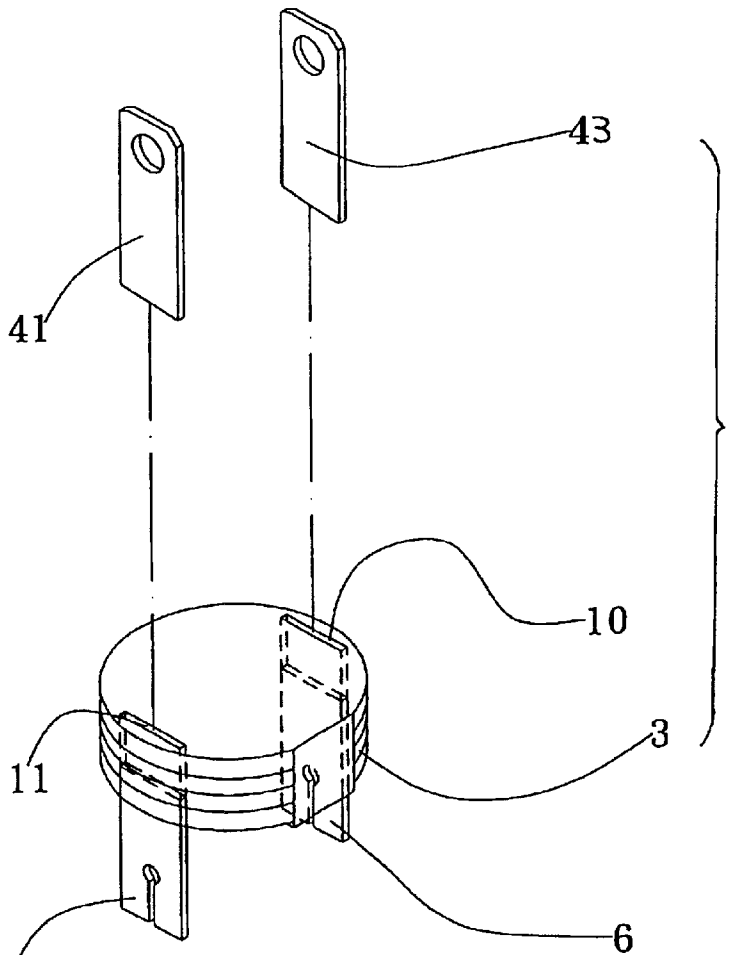
FIG. 8 is a partial exploded view of the holder fuse device as shown in FIG. 7.

Referring to FIG. 8, the conductor extensions 41, 43 may be separated from the planar conductor blades 2, 6 and may then be engaged into the slots 33, 34 of the base 3 for electrically coupling to the planar conductor blades 2, 6 respectively.

It is to be noted that the planar conductor blades 2, 6 include a planar structure and may have the grooves 22, 62 and the openings 23, 63 easily and quickly formed therein by such as molding, punching, hammering or cutting processes or the like, such that the planar conductor blades 2, 6 include a greatly simplified planar configuration for allowing the planar conductor blades 2, 6 to be easily and quickly manufactured, and for allowing the ends 51, 52 of the fuse member 5 to be easily engaged in the openings 23, 63 of the planar conductor blades 2, 6. None of the typical holder fuse devices include two planar conductor blades having grooves 22, 62 and openings 23, 63 formed therein to receive and retain the ends 51, 52 of the fuse member 5.

Figure 9:
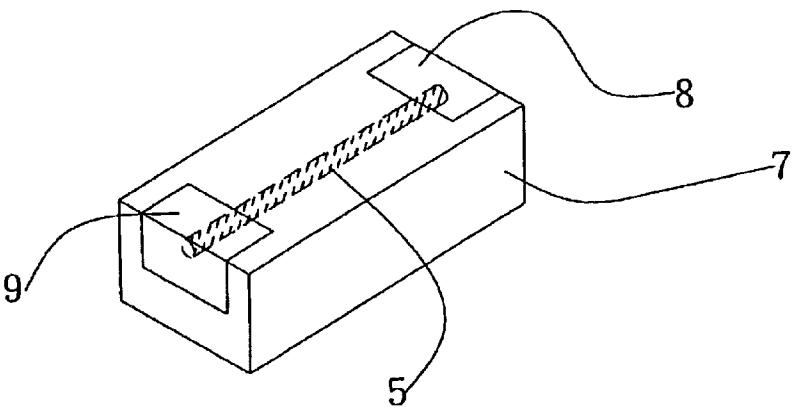
FIG. 9 is a perspective view illustrating the further arrangement of the holder fuse device.

Referring next to FIG. 9, the fuse member 5 may also be secured in a casing 7, and two conductor members 8, 9 provided on the ends of the casing 7 and electrically coupled to the ends of the fuse member 5 for electrically plugging or coupling or securing to the other objects.

Accordingly, the holder fuse device in accordance with the present invention includes a simplified structure for facilitating the manufacturing of the holder fuse device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A holder fuse device comprising:

a base, two planar conductor blades secured to said base and extended outward of said base, each of said planar conductor blades including a groove formed therein and defined between two ears, and including an opening formed therein and communicating with said groove thereof, said groove of each of said planar conductor blades including a width smaller than that of said opening of said planar conductor blades, and each of said planar conductor blades including a conductor extension extended out of said base and having a polygonal cross section, a fuse member including two ends engaged into said opening of said planar conductor blades via said grooves of said planar conductor blades, said ends of said fuse member including a diameter greater than that of said opening of said planar conductor blades, to secure and retain said ends of said fuse member in said opening of said planar conductor blades, and a cover secured to said base, to shield and to retain said fuse member and said planar conductor blades in said base, and to prevent said fuse member from being disengaged from said base.

* * * * *